US006315380B1

(12) United States Patent
Yokoi

(10) Patent No.: US 6,315,380 B1
(45) Date of Patent: Nov. 13, 2001

(54) INK JET HEAD HAVING OPERATING CHARACTERISTIC INFORMATION, AND RECORDING APPARATUS USING SUCH A HEAD

(75) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/822,765

(22) Filed: Mar. 24, 1997

Related U.S. Application Data

(63) Continuation of application No. 08/387,617, filed on Feb. 13, 1995, now abandoned, which is a continuation of application No. 08/173,464, filed on Dec. 27, 1993, now abandoned, which is a continuation of application No. 07/531, 302, filed on May 31, 1990, now abandoned.

(30) Foreign Application Priority Data

May 31, 1989 (JP) ..... 1-138291

(51) Int. Cl.[7] ..... B41J 2/01
(52) U.S. Cl. ..... 347/19; 347/41
(58) Field of Search ..... 247/9, 14, 19, 247/16, 49, 86, 67, 37, 41, 20, 104; 346/139 R, 139 C; 400/61, 76, 175, 320, 322

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,577,200 | | 3/1986 | Rix et al. | 347/49 |
| 4,695,855 | * | 9/1987 | Ichihashi et al. | 347/42 X |
| 4,723,129 | | 2/1988 | Endo et al. | 347/56 |
| 4,737,041 | * | 4/1988 | Nakayama et al. | 400/582 |
| 4,739,415 | * | 4/1988 | Toyono et al. | 347/9 X |
| 4,740,796 | | 4/1988 | Endo et al. | 347/56 |
| 4,748,453 | * | 5/1988 | Lin et al. | 347/41 |
| 4,789,874 | * | 12/1988 | Majette et al. | 347/37 |
| 4,803,500 | | 2/1989 | Milbrandt | 347/49 |
| 4,872,027 | * | 10/1989 | Buskirk et al. | 347/19 |
| 4,930,915 | * | 6/1990 | Kikuchi et al. | 400/175 |
| 5,049,898 | * | 9/1991 | Arthur et al. | 347/19 |
| 5,155,497 | * | 10/1992 | Martin et al. | 347/33 |
| 5,235,351 | * | 8/1993 | Koizumi | 347/49 X |

FOREIGN PATENT DOCUMENTS

| | | |
|---|---|---|
| 0143250 | 6/1985 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 62-16663 | 1/1988 | (JP) . |
| 63-13752 | 1/1988 | (JP) . |
| 63-4980 | 1/1988 | (JP) . |
| 63-4981 | 1/1988 | (JP) . |
| 63-170039 | 7/1988 | (JP) . |
| 63-262255 | 10/1988 | (JP) . |
| WO8903768 | 5/1989 | (WO) . |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

An ink jet recording apparatus includes a feeder for feeding a recording medium; a carriage reciprocally movable relative to the recording medium; an ink jet recording head detachably mountable on the carriage and having electrothermal transducers for producing thermal energy contributable to ejection of recording ink through ejection outlets thereof, the recording head has an ejection outlet information setting portion wherein a number and a pitch of the ejection outlets of the ink jet recording heads are set; and control circuit for detecting the ejection outlet information in the ejection outlet information setting portion, for discriminating the number and the pitch of the ejection outlets from the detected ejection outlet information, and for determining ejection timing of the recording head and a feed pitch of the recording medium by the feeder on the basis of the number and the pitch of the ejection outlets.

18 Claims, 15 Drawing Sheets

INK JET HEAD HAVING OPERATING CHARACTERISTIC INFORMATION, AND RECORDING APPARATUS USING SUCH A HEAD

This application is a continuation of application Ser. No. 08/387,617, filed Feb. 13. 1995, abandoned which was a continuation of application Ser No. 08/173,464, filed Dec. 27, 1993, which was a continuation of application Ser. No. 07/531,302, filed May 31, 1990, both now abandoned.

FIELD OF THE INVENTION AND RELATED ART

The present invention relates to an ink jet recording head and an ink jet recording apparatus.

Referring first to FIG. 19, an example of conventional ink jet recording apparatus will be described, wherein an ink jet recording head having a plurality of ink ejection outlets ejects ink to effect the recording, while relative movement is imparted between the recording head and a recording medium.

When printing instructions are supplied to the ink jet recording apparatus from an external apparatus such as a host computer under the condition that the main switch is actuated, the printing instructions are analyzed by the control circuit 8, and then the printing operation is started. Then, an LF (line feed) motor 7 is driven, and the same driving force operates a conveying roller 6 to feed the recording medium 11 to a predetermined recording position. Thereafter, a CR motor 3 is driven, and the driving force is transmitted to the carriage 2 through the conveying belt 4, so that the ink jet recording head 1 supplied with recording ink through an ink supply passage 9 from an ink tank 10 is moved in a main scan direction A. At the recording position, recording ink is ejected from the ink jet recording head to the recording medium 11, by which the recording is effected. At this time, a subordinate scanning is effected by driving the LF motor 7 effective to convey the recording medium 11 in a subordinate scanning direction (subscan) B. By repeating the main scan and subscan, the recording operation is effected over the surface of the recording medium. The pitch of ink ejections in the main scan direction and the pitch of the recording medium feed in the subscan direction B are fixedly determined at the respective one levels to match the pitch of the ejection outlets and the number of ejection outlets of the ink let recording head 1.

In an ink jet recording apparatus such as a so-called full-line head in which only the recording medium is advanced, while the ink jet recording head is fixed relative to the recording medium, the pitch of the ink ejections and the pitch of the recording material feed are similarly determined fixedly at the respective one values to match the pitch of the ejection outlets and the number of ejection outlets of the ink jet recording head.

Since the scanning pitches in the main scan direction and the subscan direction are determined fixedly to match the pitch of the ejection outlets and the number of ejection outlets of the ink jet recording head used therewith, only one ink jet recording head is usable. Therefore, even if a user wants to arrange one ink jet recording apparatus for a wide variety of uses, it is not possible. For example, the user having a high quality ink jet recording apparatus with small ejection outlet pitch may want to carry out the printing operation at a high speed with low resolution at low running cost, when, for example, a large amount of data such as experimental data are to be processed. However, this is not possible because the scanning pitches of the recording apparatus are fixed in the main scan direction and the subscan direction. Some application program for a host computer to drive the printer designates the resolution of the printer driven thereby. Even if the user wants to use the application program, it is not possible if his or her printer does not match it. In other words, the use of the printer is narrow directed, and therefore, the user who needs a variety of uses has to buy a number of recording machines with the result of forcing considerable cost to the user.

SUMMARY OF THE INVENTION

Accordingly, it is a principal object of the present invention to provide an ink jet recording apparatus and an ink jet recording head capable of a variety of uses with high cost performance.

It is another object of the present invention to provide an ink jet recording head having a number of ink ejection outlets and having ejection outlet information representative of the number and pitch of the ejection outlets.

It is a further object of the present invention to provide an ink jet recording head having a number of ink ejection outlets and having ejection outlet information setting portion for setting the ejection outlet information indicative of the number or pitch of the ejection outlets.

Preferred embodiments of the invention are suitably usable with an ink jet recording head having electrothermal transducers for producing thermal energy contributable to eject the recording ink through the ejection outlets.

According to an aspect of the present invention, there is provided an ink jet recording apparatus, comprising: means for feeding a recording medium; a carriage reciprocally movable relative to the recording medium; an ink jet recording head detachably mountable on said carriage and having electrothermal transducers for producing thermal energy contributable to ejection of recording ink through ejection outlets thereof, said recording head has an ejection outlet information setting portion wherein a number and a pitch of the ejection outlets of said ink jet recording heads are set; and control circuit for detecting the ejection outlet information in the ejection outlet information setting portion, for discriminating the number and the pitch of the ejection outlets from the detected ejection outlet information, and for determining ejection timing of said recording head and a feed pitch of the recording medium by said feeding means on the basis of the number and the pitch of the ejection outlets.

In an embodiment of the present invention of this aspect, there is provided an apparatus wherein a unit movement amount of said carriage is an integer reciprocal of the pitch of the ejection outlets of each of different ink jet recording heads usable with said apparatus.

In another embodiment of the present invention, there is provided an apparatus wherein a unit feed pitch of the recording medium is an integer reciprocal of a product of the number of ejection outlets and the pitch of the ejection outlets of each of different ink jet recording heads usable with said apparatus.

In a further embodiment of the present invention, there is provided an apparatus further comprising a slit plate having plural slits arranged at regular intervals in a direction of carriage movement, and an optical encoder movable together with said carriage adjacent said slit plate to detect the slit to produce slit detection signals and to supply them to said control circuit.

In a further embodiment of the present invention, there is provided an apparatus wherein the slit interval is an integer multiple of the pitch of the ejection outlets of each of different ink jet recording heads usable with said apparatus.

According to another aspect of the present invention, there is provided an ink jet recording apparatus, comprising: means for feeding a recording medium; a carriage reciprocally movable relative to the recording medium; an ink let recording head detachably mountable on said carriage and having electrothermal transducers for producing thermal energy contributable to ejection of recording ink through ejection outlets thereof, said recording head has an ejection outlet information setting portion wherein a number or a pitch of the ejection outlets of said ink jet recording heads are set; and control circuit for detecting the ejection outlet information in the ejection outlet information setting portion, and for determining ejection timing of said recording head relative to a feed pitch of the recording medium by said feeding means on the basis of the detected ejection outlet information.

In an embodiment of this aspect of the invention, there is provided an apparatus wherein a unit feed pitch of the recording medium is an integer reciprocal of the pitch of the ejection outlets of each of different ink jet recording heads.

The ink jet recording head is provided with means indicative of the ejection outlet information relating at least one of the number of ejection outlets of the ink jet recording head and the pitch of the ejection outlets. Since the recording head is detachably mountable to the ink jet recording head, an ink jet recording head can be selected depending on the intended use, and in addition, the proper ejection timing can be set in accordance with the ejection outlet information provided in the ink jet recording head. Where the ink jet recording apparatuses such that the recording medium is fed, and the ink jet recording head is mounted on a carriage reciprocable relative to the recording medium, a unit amount of feed of the recording medium, and a unit amount of movement of the carriage are determined. In this case, when the ink jet recording head with the setting of the number and the pitch of the ejection outlets on the ink jet recording head is mounted on the carriage, the ejection outlet information is detected, and the number and the pitch of the ejection outlets of the recording head are discriminated. Then, on the basis of the information, the unit amount of movement of the carriage and the unit amount of feed of the recording medium, the determination is made as to the amount of feed of the recording medium and the ejection timing of the ink jet recording head matching the unit amount of movement of the carriage, for each of the recording heads mounted on the carriage.

In addition, in the above ink jet recording apparatus, the unit amount of the carriage movement is predetermined to be a pitch multiplied by a reciprocal of an integer multiplied by a pitch (an integer reciprocal of the pitch) of ejection outlets of any of predetermined different ink jet recording heads usable with the ink jet recording apparatus; or the unit amount of the recording medium feed is determined to be an integer reciprocal of a product of the pitch and the number of ejection outlets (pitch×number) of any of different ink jet recording head predetermined as being usable with the ink jet recording apparatus. By doing so, the ejection timing and the recording medium feeding amount are easily set for the ink ejection recording head.

A slit plate may be disposed extended in the direction of the carriage movement, the slit plate having slits at a pitch which is an integer multiple of the ejection outlets of any of the usable recording heads. By detecting the slits of the slit plate by an optical encoder, the ejection timing of the ink jet recording head may be determined with reference to the detection intervals of the slits.

Where the ink jet recording head is mounted on a carriage which is stationary relative to the recording medium, while the recording medium is fed, the unit amount of the recording medium feed is determined.

In this case, when the ink jet recording head with the setting of the number and the pitch of the ejection outlets thereon is mounted on the carriage, the number or the pitch of ejection outlets of the ink jet recording head are discriminated. Then, on the basis of the information and the unit amount of the recording medium feed, the ejection timing of the ink jet recording head responsive to the unit amount of the recording medium feed during the recording operation can be determined, for the mounted one of the recording heads on the carriage. Further, in this case, the unit amount of the recording medium feed may be determined to be an integer reciprocal of a pitch of the ejection outlet of any different recording heads predetermined as to be usable. By doing so, the ejection timing can be easily set.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
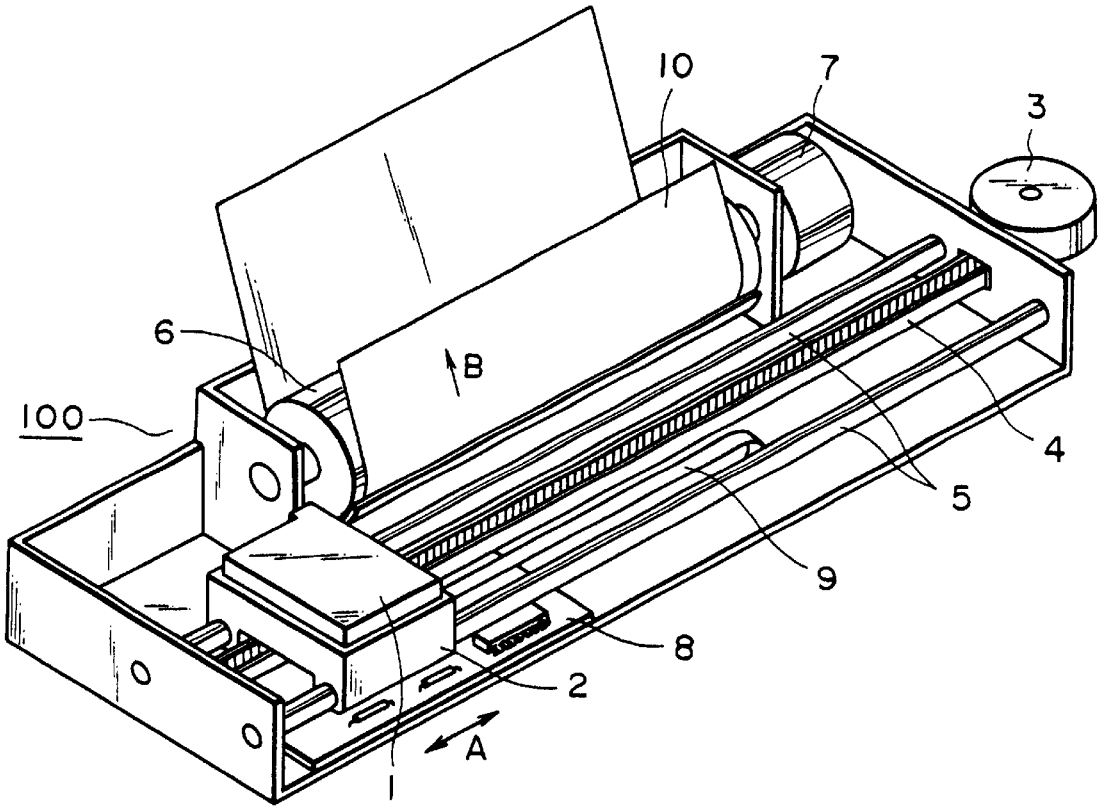
FIG. 1 is a perspective view of an ink jet recording apparatus according to an embodiment of the present invention.

Referring to FIG. 1, there is shown an ink jet recording head and an ink jet recording apparatus according to an embodiment of the present invention.

An ink jet recording apparatus 100 comprises a carriage 2 for mounting thereon an ink jet recording head 1. The carriage 2 receives driving force of a CR motor 3 through a driving belt 4, and is mounted for reciprocation on a carriage shaft 5. By the reciprocation of the carriage 2, the ink jet recording heady 1 scans a recording medium 10 in a main scan direction A.

Figure 2:
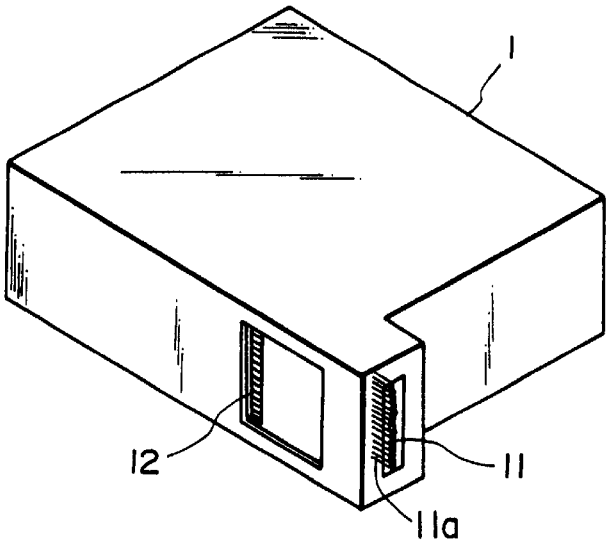
FIG. 2 is a perspective view of an ink jet recording head according to an embodiment of the present invention.
Figure 3:
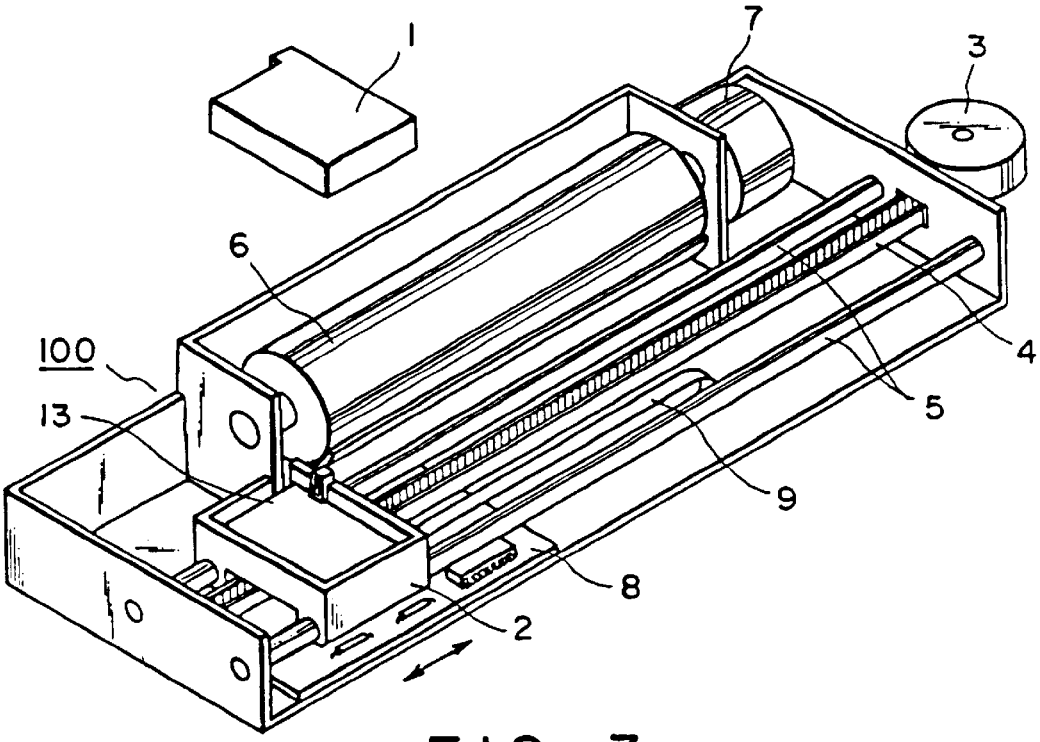
FIG. 3 is a perspective view of the ink jet recording apparatus without the ink jet recording head.

The ink jet recording head is detachably mountable on the carriage 2 and is provided with a plurality of ejection outlets 11 through which recording ink is ejected by electrothermal transducers 11*a*, as shown in FIG. 2. The carriage 2 is further provided with a connector 12 electrically connectable with a connector 13 when it is mounted on the carriage 2. The connector 13, as shown in FIG. 3 is provided in the carriage 2 and is connected with a control circuit 8 by a cable 9. The ink jet recording head 1 has therein electric resistors 20*a*, 20*b* and 20*c* indicative of the pitch and the number of the ejection outlets 11 of the ink jet recording head. In this embodiment, the ink jet recording apparatus 100 is usable with a recording head with the ejection outlet pitch corresponding to 180 dpi (dots per inch) and the ejection outlet number of 30, a recording head having 300 dpi and 50 outlets, a recording head having 300 dpi and 100 outlets, and a recording head 360 dpi and 60 outlets, and a recording head having 360 dpi and 120 outlets.

Figure 4:
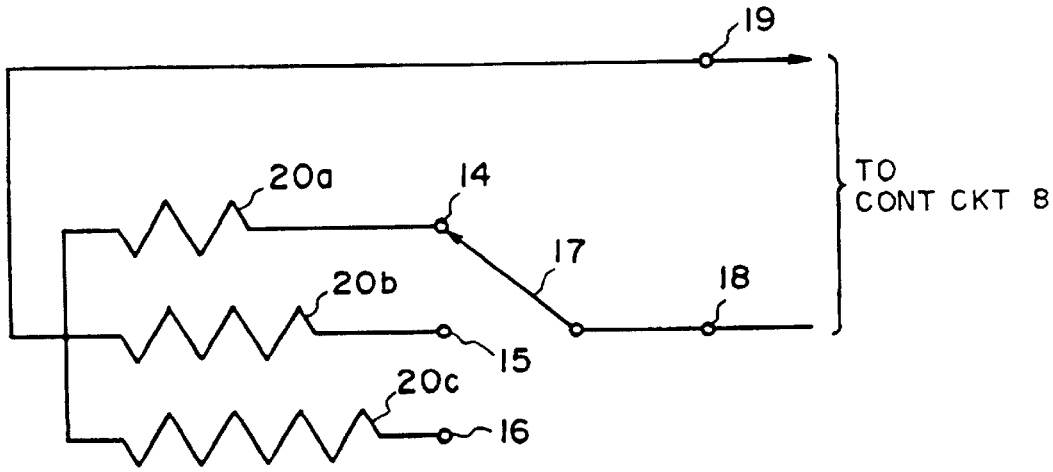
FIG. 4 is a circuit diagram showing an example of an ink ejection outlet information setting portion of an ink jet recording head.

As shown in FIG. 4, three resistors are provided, i.e., the resistor 20*a* for 180 dpi, a resistor 20*b* for 300 dpi and a resistor 20*c* for 300 dpi. One end of each of them is connected to a common terminal 19, and the other end is connected to a selection terminal 14, 15 or 16 of an ejection outlet pitch selector switch 17, so that a resistor corresponding to the ejection outlet pitch of the ink jet recording head can be selected. The common terminal 19 and a common terminal 18 of the switch are connected to electrodes of the connector 12. The resistors indicative of the number of ejection outlets of the ink jet recording head 1 are not shown but include a resistor for 30 outlets, a resistor for 50 outlets, a resistor for 60 outlets, a resistor for 100 outlets and a resistor for 120 outlets (five resistors). Similarly to the case of the ejection outlet pitch, selection is possible by a ejection outlet number selector switch. A common terminal for the ejection outlet number resistor and a common terminal of the switch are connected to the electrodes of the connector 12, similarly. The ink jet recording head 1 has an ink container and also has electrothermal transducers (not shown) for producing thermal energy contributable for the ejections of the recording ink through the ejection outlets 11.

The CR motor 3 for driving the carriage 2 is in the form of a pulse motor. A minimum pitch, that is, the distance of the carriage 2 movement in a main scan direction A by one step is $1/1800$ inch which is a maximum common divisor of $1/180$ inch, $1/300$ inch and $1/360$ inch. The recording medium 10 is fed in the subscan direction B by rotation of the conveying roller 6 driven by an LF motor 7 which is in the form of a pulse motor. The minimum pitch, that is, the distance of the movement of the recording medium 10 in the subscan direction B by one step of the LF motor 7 is $1/12$ inch which is a common divisor of ($1/180$) inch×30, ($1/300$) inch×50, ($1/300$) inch×100, ($1/360$) inch ×60 and ($1/360$) inch×120. When the ink jet recording head is mounted on the carriage 2 of the ink jet recording apparatus 100, the connector 12 and the connector 13 are connected.

Figure 5:
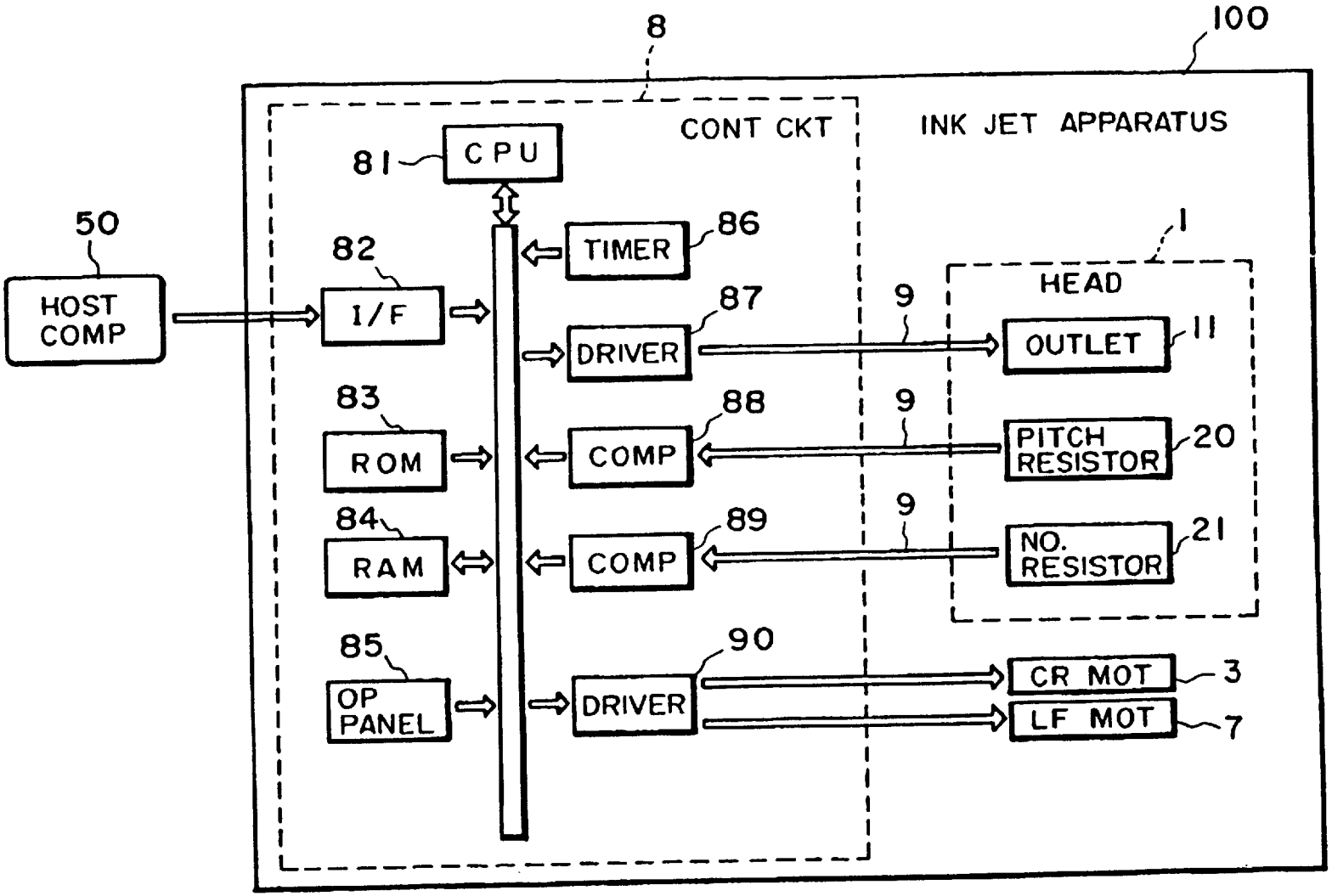
FIG. 5 is a block diagram of a control circuit of an ink jet recording apparatus.

As shown in FIG. 5, by this connection, the resistors 20 and 21 indicative of the pitch and the number of ejection outlets of the ink jet recording head 1 are connected to the control circuit 8. The control circuit 8 in the ink jet recording head 100, as shown in FIG. 5, comprises a CPU (central processing unit) 81, I/F 82, ROM 83, RAM 84, an operation panel 85, a timer 86, a drivers 87 and 90 and comparators 80 and 89.

The interface circuit I/F 82 functions as an interface with an external apparatus, that is, the host computer 50. The comparator 88 is connected with an ejection outlet pitch resistor 20 in the ink jet recording head 1 through a cable 9, when the ink jet recording head 1 is mounted on the carriage 2. It detects the resistance of the ejection outlet pitch resistor 20 to discriminate the ejection outlet pitch (P) of the recording head, 1, and the discriminated pitch is supplied to the CPU 81. The comparator 89, similarly to the comparator 88, is connected to the ejection outlet number resistor 21 to detect the resistance of the ejection outlet number resistor 21 and discriminate the number of ejection outlets (n). The discriminated number of ejections (n) is supplied to the CPU 81. The timer 86 supplies to the CPU 81 and to the driver 90 a timer pulse which is a reference of the CPU 81 operation and the driving pulses of the CR motor 3 and the LF motor 7. The driver 90 receiving the timer pulse produces driving pulses for the CR motor 3 and the LF motor 7 to drive the CR motor 3 and the LF motor 7.

The CPU 81 operates in accordance with the program stored in the ROM 83 with the reference of the timer pulse from the timer 86. It determines the ejection timing of the ink jet recording head 1 with respect to the driving pulse of the CR motor 3 in accordance with the ejection outlet pitch (P) discriminated by the comparator 88. On the basis of the ejection outlet pitch (P) and the number of ejection outlets (n) discriminated by the comparator 89, it determines (ejection outlet pitch (P)×ejection outlet number (n)). From the determined product of the ejection outlet pitch (P), and the ejection outlet number (n) and the minimal feed pitch of the recording medium 10 by one step of the LF motor 7, a unit amount of feed in the subscan direction of the recording medium 10, that is, the number of driving pulses of the LF motor 7 per one subscan movement is determined. In accordance with the determined ejection timing, the image data stored in the RAM 84 are read and are outputted as ejection signals to the ejection outlets 11 of the ink jet recording head 1 through the driver 87.

When, for example, an ink jet recording head 1 having an ejection outlet pitch of 300 dpi and a number of ejection outlets 100, the ejection outlet pitch selector switch 17 and the ejection outlet number selector switch in the ink jet recording head 1 are set to select the resistance 20*a* for 300 dpi and a resistor for 100 discharging outlets, and then the recording head 1 is mounted on the carriage 2. Then, the control circuit 8 discriminates the ejection outlet pitch (P) corresponding to 300 dpi and the number of ejection outlets (n) of 100, and determines the ejection timing of the ink jet recording head 1 and the amount of the feed of the recording medium 10. In this case, the ink ejection is effected from the ink jet recording head 1 during the main scan once per 6 driving pulses of the CR motor 30, and the number of subscan pulses per one subscan, that is, the unit amount of feed of the recording medium 10 corresponds to four driving pulses of the LF motor 7.

Figure 7:
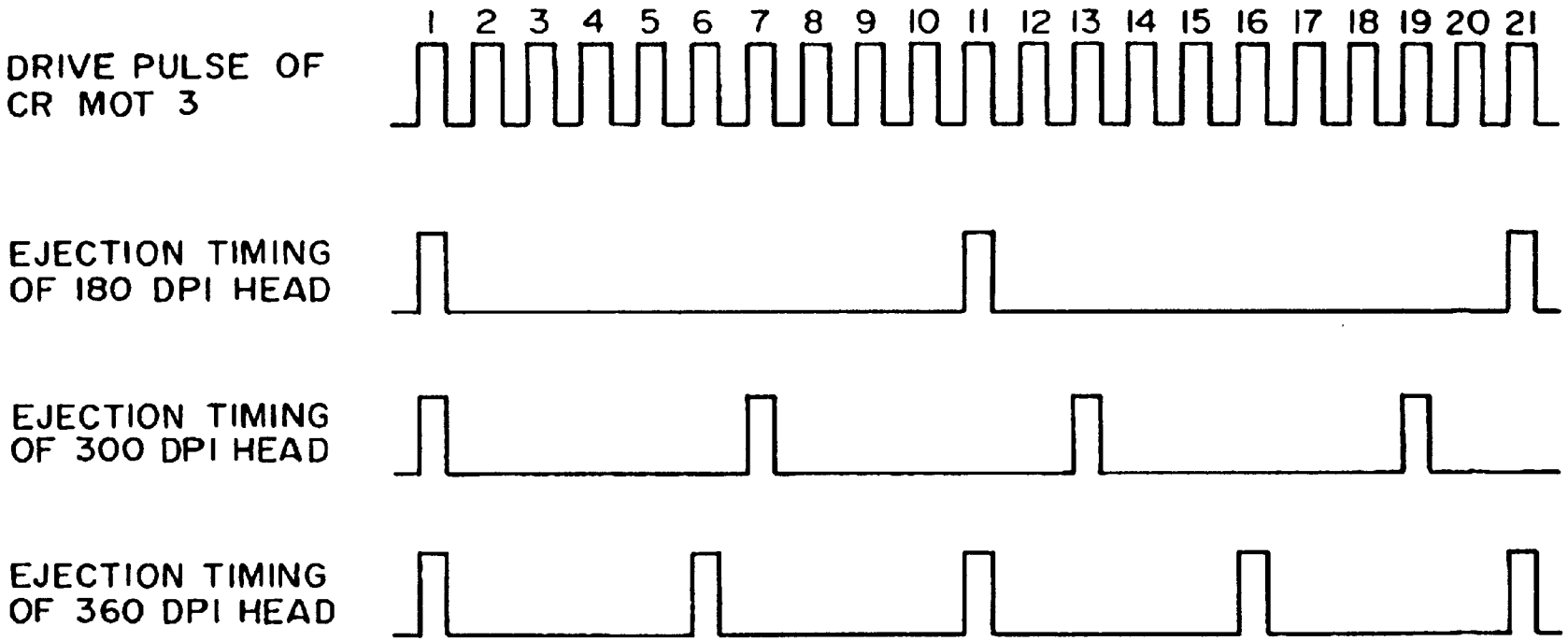
FIG. 7 is a timing chart showing an example of ejection timing of the ink jet recording head responsive to a driving pulse from a CR motor.
Figure 8:
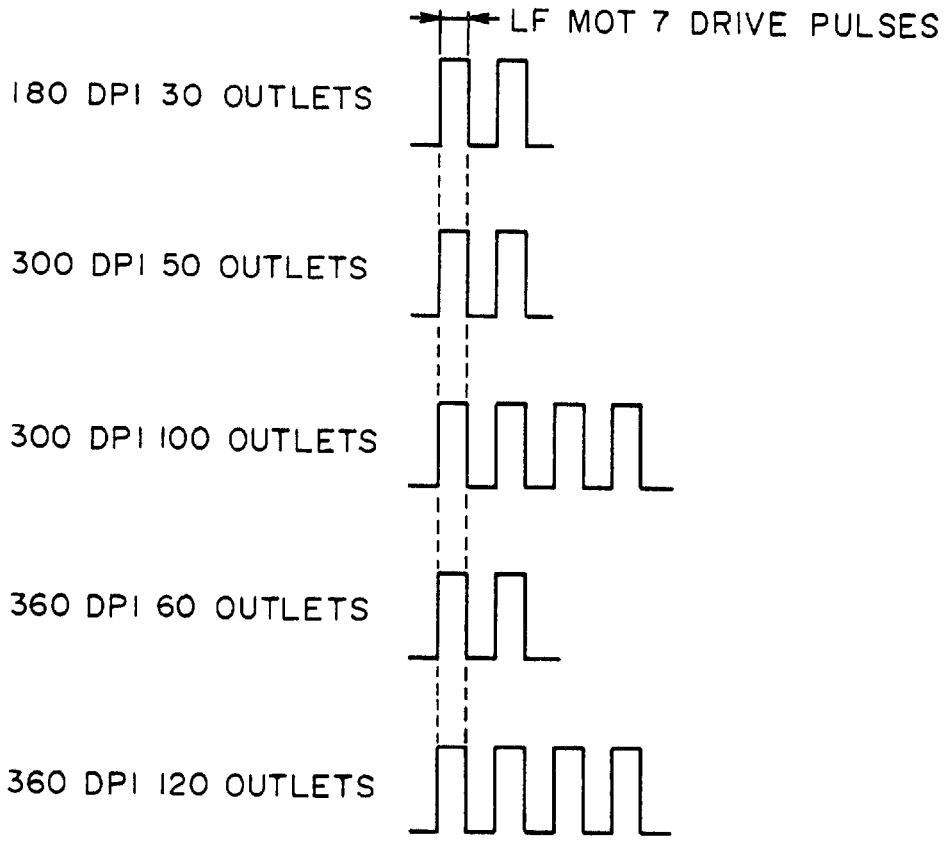
FIG. 8 is a timing chart showing a distance of recording material feed responsive to the driving pulse from an LF motor per one subscan.

Referring to FIGS. 7 and 8, there are shown the ejection timing of the ink jet recording head 1 relative to the driving pulse of the CR motor 3 and a number of driving pulses of the LF motor 7 per one subscan movement of the recording medium 10, in this embodiment.

As shown in FIG. 7, the ejection timing of the ink jet recording head 1 having the ejection outlet pitch of 180 dpi corresponds to 10 driving pulses of the CR motor 3; and when the ejection pitch is 360 dpi, it corresponds to 5 pulses.

As shown in FIG. 8, the number of driving pulses of the LF motor 7 per one subscan movement of the recording medium 10 is 2 when the recording head has 180 dpi and 30 outlets, when it has 300 dpi and 50 outlets and when it has 360 dpi and 60 outlets. The number of driving pulses is 4 when the ink jet recording head 1 has 300 dipi and 100 outlets, and when it as 360 dpi and 120 outlets.

Figure 6:
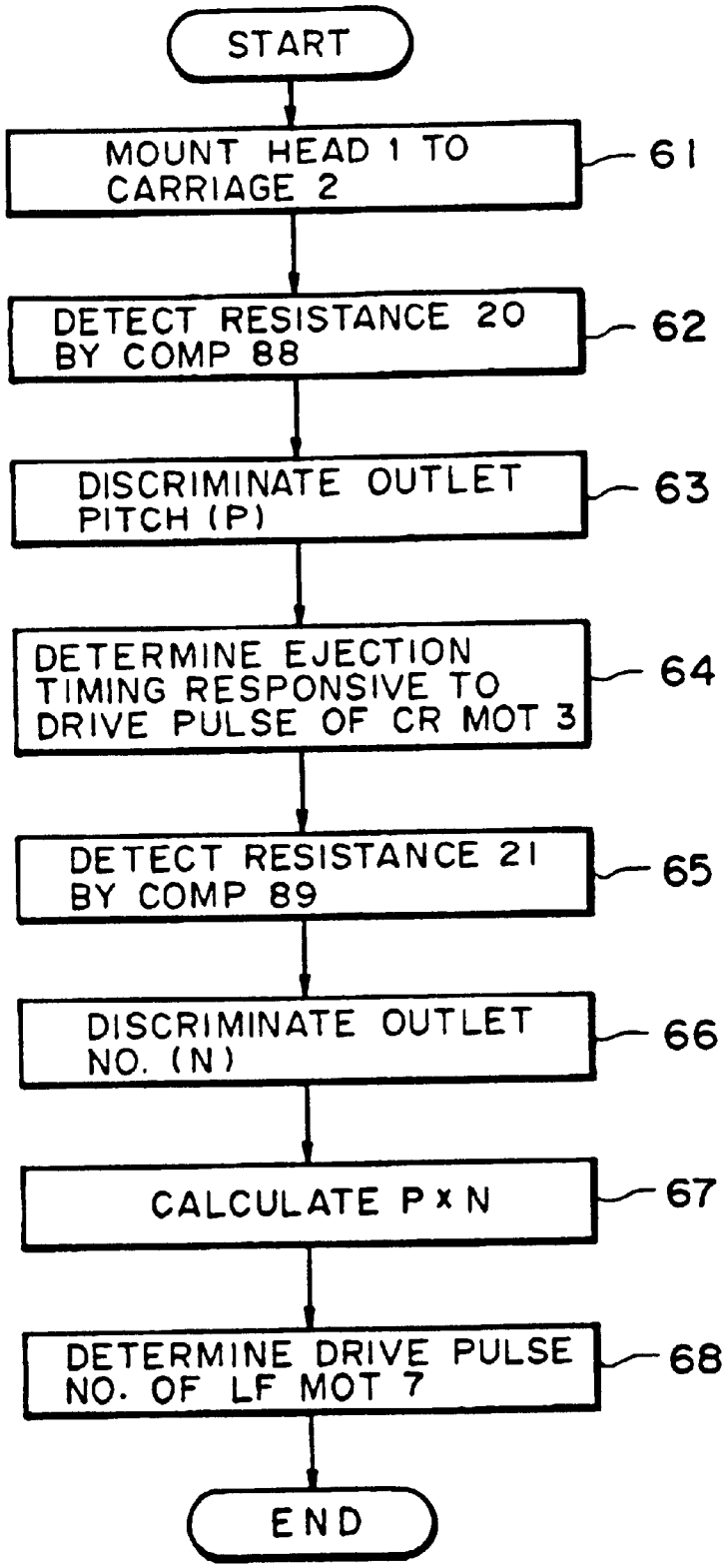
FIG. 6 is a flow chart of a sequence of an operation of the control circuit.

Referring to FIG. 6 (flow chart), the operation of the control circuit 8 will be described.

When the ink jet recording head 1 is mounted on the carriage 2 (step 61), the comparator 88 detects the resistance of the ejection outlet pitch resistor 20. From the resistance detected, the ejection outlet pitch (P) of the ink jet recording head 1 mounted on the carriage is discriminated, and the ejection outlet pitch (P) is supplied to the CPU 81 (step 63). The CPU 81, upon reception of the ejection outlet pitch (P) information from the comparator 88, the ejection timing of the ink jet recording head relative to the driving pulse of the CR motor 3 is determined (step 64).

Then, the comparator 89 detects the resistance of the ejection outlet number resistor 21 (step 65). From the detected resistance, the number of ejection outlets (n) of the ink jet recording head 1 is discriminated, and the number (n) is supplied to the CPU 81 (step 66). The CPU 81 calculates a product of the ejection outlet pitch (P) and the number of ejection outlets (n)(P×n) from the respective data supplied at the step 63 (step 67), and the number of driving pulses of the LF motor 7 per one subscan is determined (step 68).

In this manner, the ejection timing and the number of driving pulses for the subscan of the recording medium 10 are determined. When the host computer 50 produces printing instructions, the CPU 81 drives the CR motor 3 and the LF motor 7 through the driver 90, by which the main scan of the ink jet recording head 1 and the subscan of the recording medium 10 are started. Simultaneously, the CPU 81 drives the driver with the determined ejection timing in accordance with the image data stored in the RAM 84, by which the ejection signal is supplied to the recording head 1 from the driver 87, so that the recording operation is effected on the recording medium 10.

As described in the foregoing, in this embodiment, the ejection outlet pitch and number of the ink jet recording head are set using electric resistors, and resistances are detected by the comparators 88 and 89 of the control circuit 8 to determine the ejection timing and the feed amount of the recording medium 10.

Figure 9:
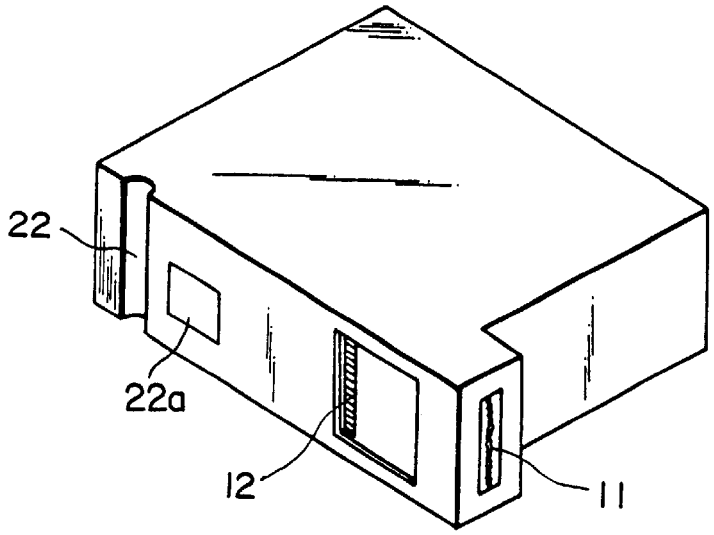
FIG. 9 is a perspective view showing another example of the ejection outlet information setting portion of an ink jet recording head.

FIG. 9 shows another example of the means for setting the ejection outlet information. The outer casing of the ink jet recording head 1 is provided with an opening 22 at the position predetermined in accordance with the ejection outlet pitch and the number. The recess 22 is detected by a photosensor or microswitch disposed on the carriage 2 or adjacent thereto to detect the pitch and the number of the ejection outlets. The recess may be replaced with a projection. Another possible example is provision of a bar code tape or magnetic tape indicative of the pitch and number of the ejection outlets provided on the outer casing of the recording head. This may be read by the reader in the recording apparatus.

As described in the foregoing, the ink jet recording head of this embodiment is usable with various ink jet recording heads 1 having different pitches and/or numbers of ejection outlets within a predetermined range, so that the operator can use the recording apparatus for a wide variety of purposes.

Figure 10:
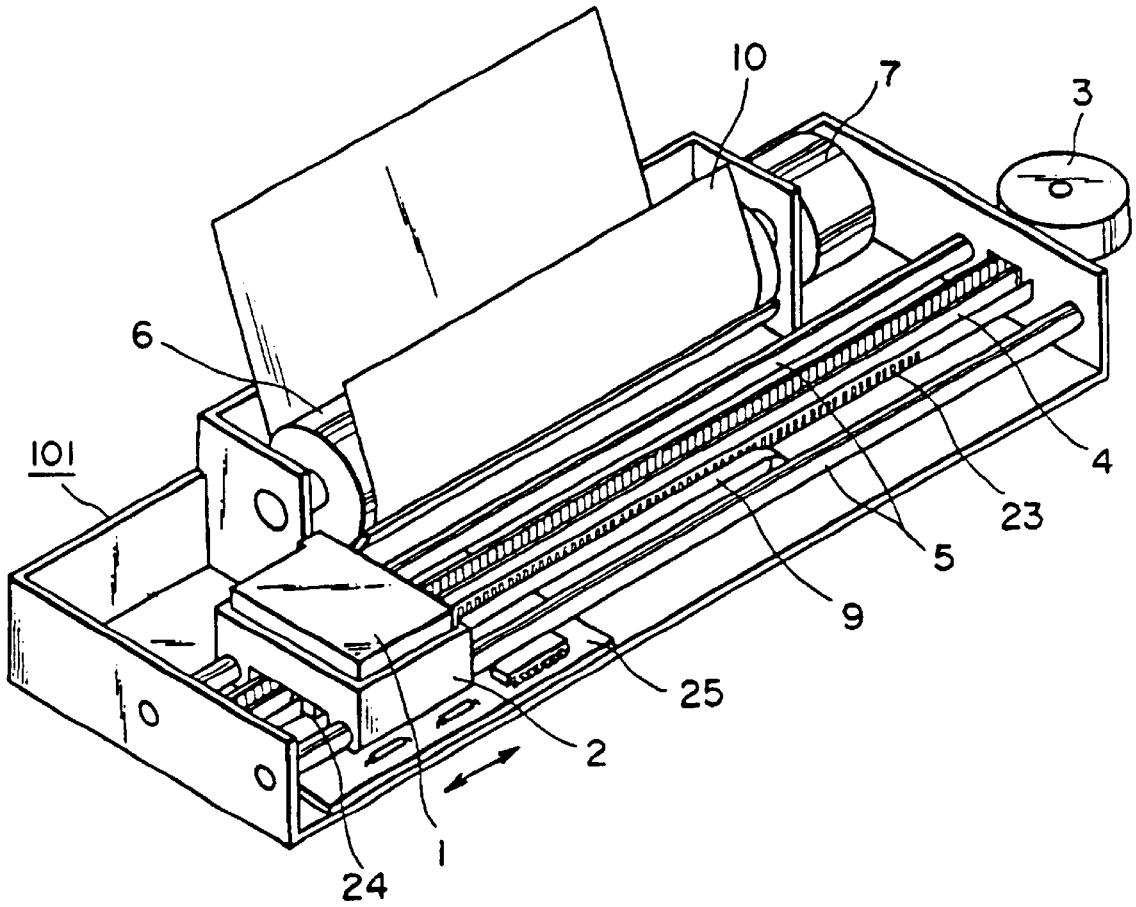
FIG. 10 is a perspective view of an ink jet recording apparatus according to a second embodiment of the present invention.

Referring to FIG. 10, a second embodiment of the invention will be described. The ink jet recording apparatus 101, similarly to the ink jet recording apparatus 100, the recording operation is effected while the carriage 2 is reciprocated on the carriage shaft 5 by the CR motor 3 in the main scan direction, and the recording medium 10 is fed in the subscan direction by the LF motor 7. The ink jet recording apparatus 101 further includes an optical encoder 24 fixed on the carriage 2. The encoder 24 has an array of optical encoder slits 23 arranged in the direction of the carriage shaft 5, and the encoder is connected with a control circuit 25. The ejection timing of the ink jet recording head is determined using the slit detection pulses by the optical encoder 24.

The slits 23 are arranged at regular intervals. The pitch of the slits is an integer multiple of the pitch of the ejection outlet of the ink jet recording head 1 usable with the ink jet recording apparatus. In this embodiment, the ink jet recording apparatus 101 is usable with an ink jet recording head 1 having the recording density of 180 dpi and the number of ejection outlets of 30, a recording head having 300 dpi and 50 outlets, a head having 300 dpi and 100 outlets, a head having 300 dpi density and 60 outlets and a head having 360 dpi density and 120 outlets, similarly to the first embodiment. Therefore, the pitch of the slits 23 for the optical encoder is $1/60$ inch which is an integer of $1/180$ inch, $1/300$ inch and $1/360$ inch. The ink jet recording head 1 has the structure similar to that of the first embodiment.

Figure 11:
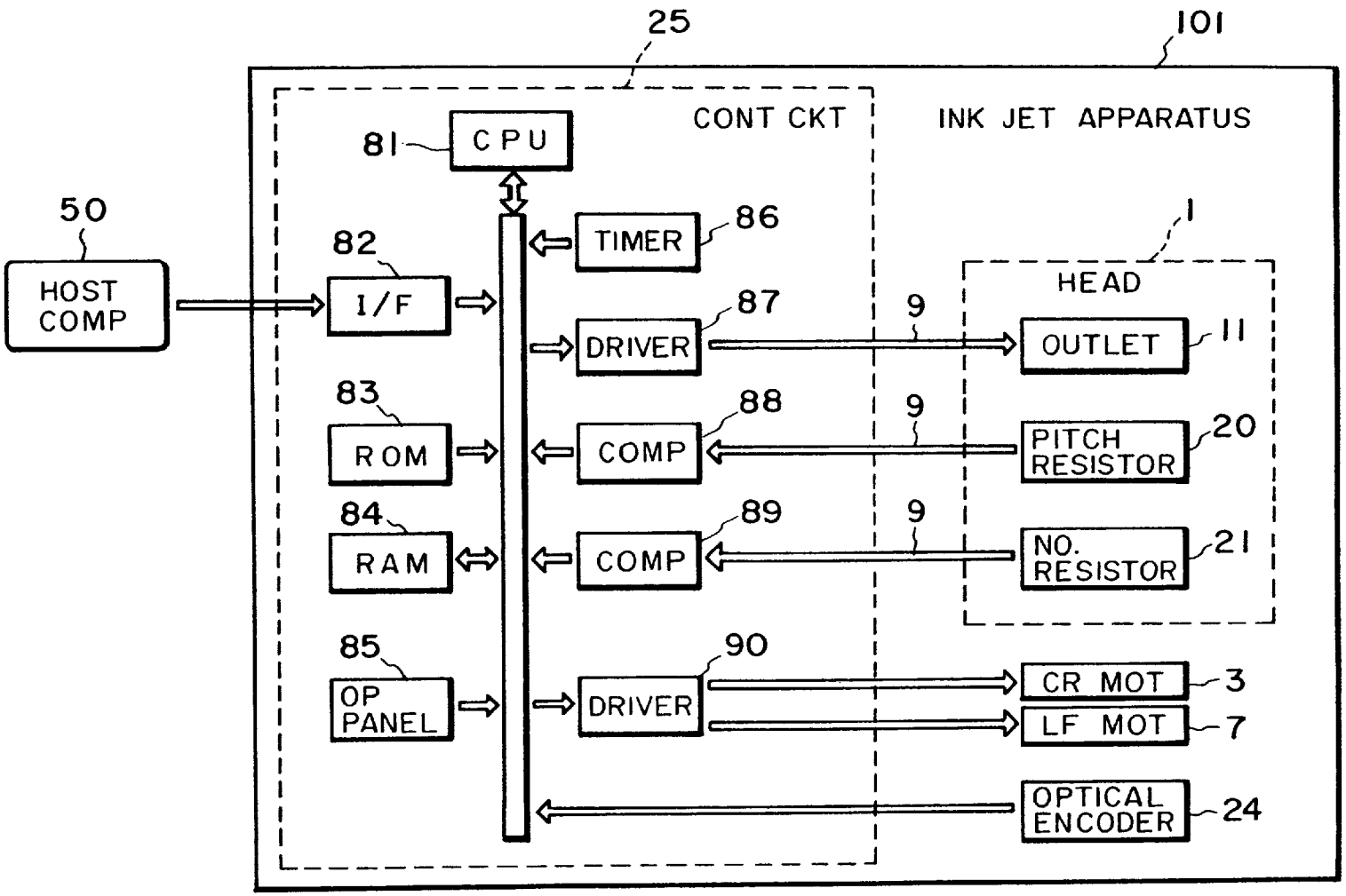
FIG. 11 is a block diagram showing an example of a control circuit of the ink jet recording apparatus of FIG. 10.

As shown in FIG. 11, a control circuit 25 for this embodiment is similar to the control circuit 8 of the first embodiment, but is connected with an optical encoder 24. The optical encoder 24 is fixed on the carriage 2, and therefore, is movable together with the ink jet recording head 1 in the main scan direction adjacent to the slits 23, and the slit detection pulses are supplied to the CPU 81.

The CPU 81 receives the data of the ejection outlet pitch (P) and the ejection outlet number (n) obtained from the detection of the resistances of the ejection outlet pitch resistor 20 and the ejection outlet number resistor 21 and also receives the slit detection pulse from the optical encoder 24. On the basis of the received data, the CPU determines a number of ejections, that is, the number of ejection pulses between adjacent slits and the ejection interval on the basis of the interval of the slit detection pulses, that is, the movement period of the recording head 1 between adjacent slits and the ejection outlet pitch. The pitch of the recording medium 10 feed in the subscan direction is determined on the product of the ejection outlet pitch (P) and the ejection outlet number (n) and the amount of one step of the LF motor 7 which is in the form of a pulse motor.

When, for example, an ink jet recording head 1 having the ejection outlet pitch corresponding to 360 dpi density and having 60 ejection outlets, the ejection timing is determined as follows. Since the pitch of the slits for the optical encoder is 1/160 inch, 6 ejection pulses are selected between adjacent slits (per one slit), and the feed distance of the recording medium 10 per one subscan corresponding to 2 driving pulses of the LF motor 7 when the minimum feeding pitch of the LF motor 7 is 1/12 inch. In the ejection intervals determined, the number of timer pulses produced by the timer 86 is discriminated, and the number of timer pulses is set as the ejection timing. When the optical encoder 24 transmits the slit detection pulse to the CPU 81 during the main scan operation of the recording head 1, the number of timer pulses produced by the timer 86 starts to be counted from that point of time. When the number of pulses reaches to the number corresponding to the ejection timing preset in the manner described above, the ejection signal is supplied to the ejection outlet 11 of the ink jet recording head 1 through the driver 87.

Figure 12:
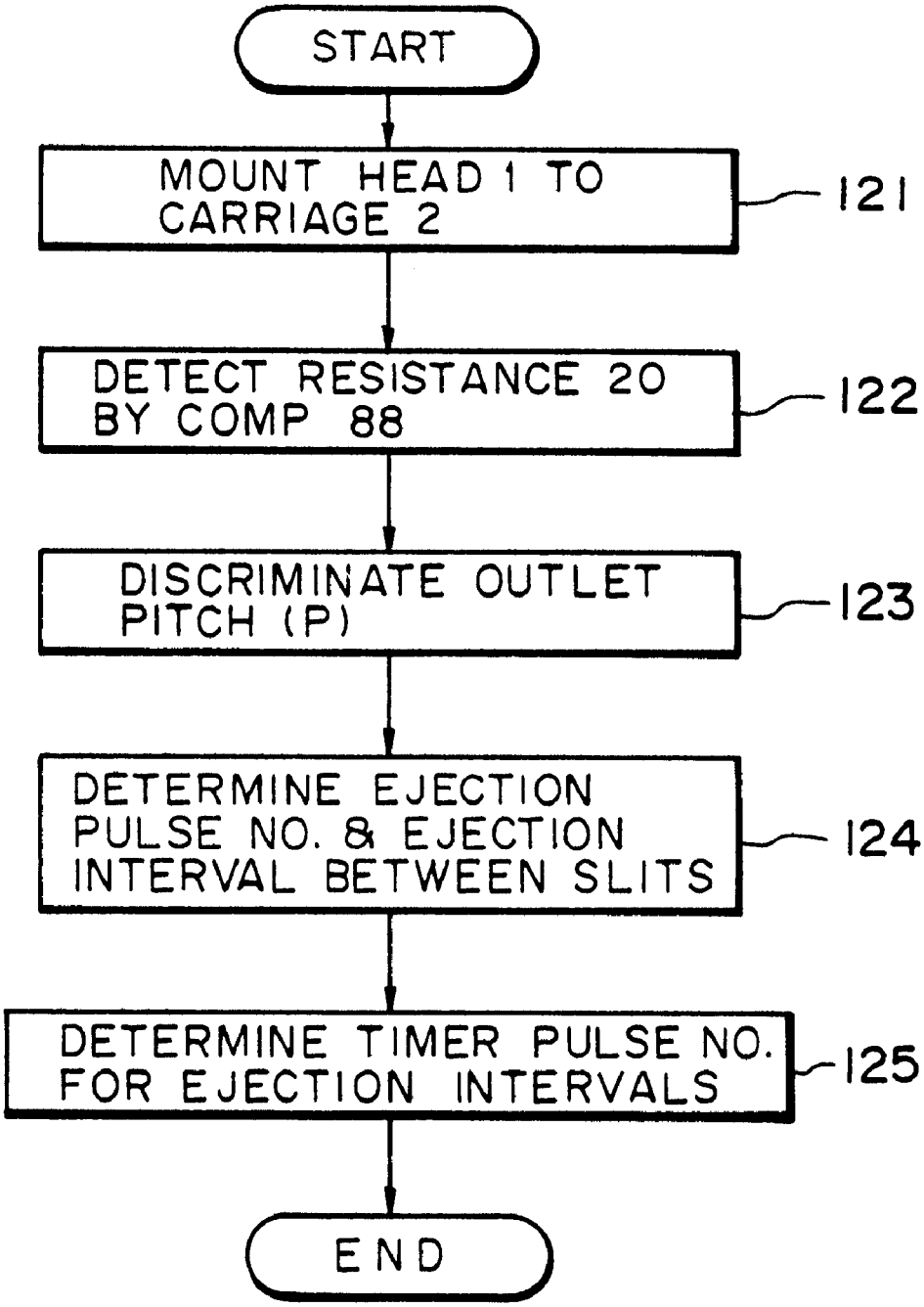
FIG. 12 is a flow chart of a sequence of an operation of the control circuit of FIG. 11.

Referring to FIG. 12, the description will be made as to the operator for setting the ejection timing in the control circuit 25.

When the ink jet: recording head 1 in which the resistances of the ejection outlet pitch resistor 20 and the ejection outlet number resistor 21 are set, is mounted on the carriage 2 (step 121), the comparator 88 detects the resistance of the ejection outlet pitch resistor 20 (step 122). On the basis of the detected resistance, the comparator 88 discriminates the ejection outlet pitch (P) of the ink jet recording head 1, and the discriminated ejection outlet pitch (P) is supplied to the CPU 81 (step 123). Receiving the data indicative of the ejection outlet pitch (P), the CPU 81 determines the ejection pulse number and the ejection interval relative to the slit detection interval by the optical encoder 24. Further, the CPU 81 discriminates the number of timer pulses by the timer 86 in the determined ejection interval, and the number of pulses is set as the ejection timing (step 125).

After the ejection timing is set, the main scan by the ink jet recording head 1 is started. When the optical encoder 24 transmits the slit detection pulse to the CPU 81, an ejection signal is supplied to the ejection outlets 11 of the ink jet recording head 1 through the driver 87 when the number of timer pulses produced by the timer 86 from that time reaches the pulse number corresponding to the set ejection timing.

Figure 13:
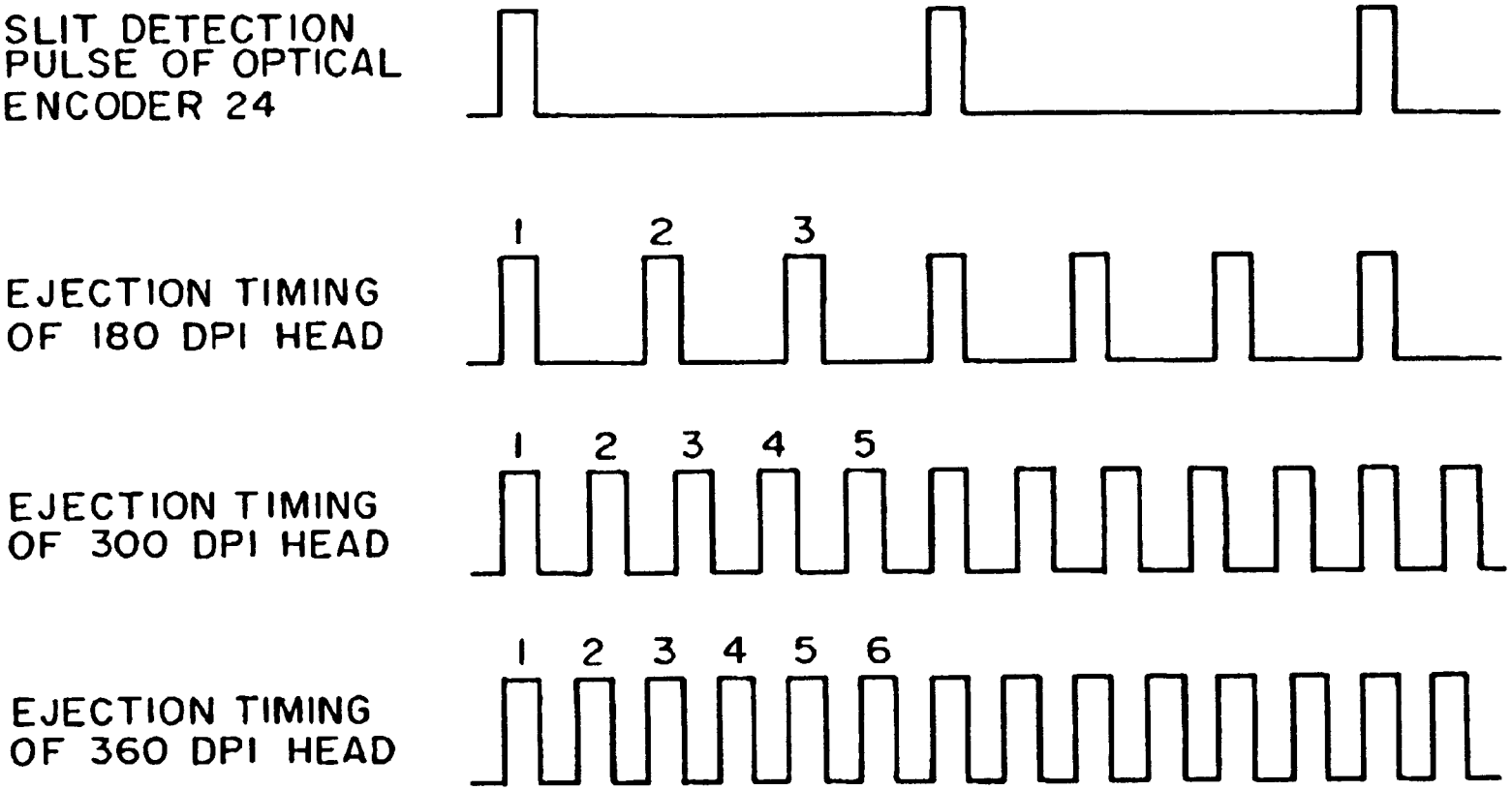
FIG. 13 is a timing chart showing an example of ejection timing of the ink jet recording head responsive to a slit detection pulse of an optical encoder.

Referring to FIG. 13, shown is the ejection timing of ink jet recording heads 1 usable with the ink jet recording apparatus 101 and having the ejection outlet pitch corresponding to 180 dpi density, 300 dpi density and 360 dpi density.

The ink jet recording head 1 moves at a constant speed by the driving force from the CR motor 3. Since the pitch of the slits for the optical encoder is 1/60 inch, the ejection timing is selected such that 3 in one slit detection pulse interval when the recording head 1 has the recording density of 180 dpi. Similarly, when it is 300 dpi and 360 dpi, it is 5 and 6, respectively.

Figure 14:
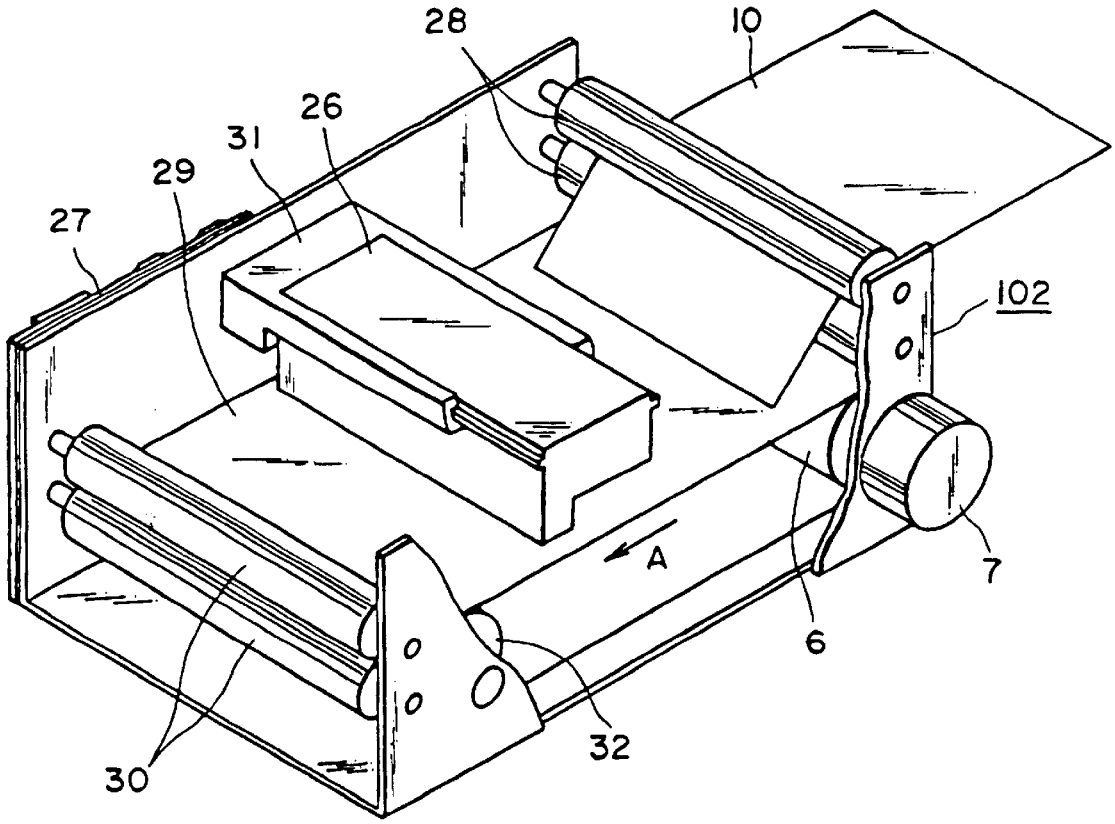
FIG. 14 is a perspective view of a third embodiment of an ink jet recording apparatus according to a third embodiment of the present invention.

Referring to FIG. 14, a third embodiment of the present invention will be described. FIG. 14 is a perspective view of an ink jet recording head 26 and an ink jet recording apparatus 102 according to the third embodiment of the present invention. The ink jet recording apparatus 102 in this embodiment is usable with a line type ink jet recording head 26. The ink jet recording head 26 is fixed on the recording apparatus 102, and only the recording medium 10 is fed by the LF motor 7 through a conveying belt 29 in a scanning direction A which is the main scan direction in this case. Thus, the relative movement is imparted between the recording medium 10 and the recording head 26. The line type recording head 26 in this embodiment is a so-called full-line type having a number of ejection outlets covering at least the recording area for the recording medium. The ink jet recording head 26 is easily detachably mountable with respect to the carriage 31. In this embodiment, the recording head 26 having the recording densities of 180 dpi, 300 dpi and 360 dpi, respectively, are selectively usable. The recording medium 10 is supplied onto the conveyer belt 29 stretched between the conveying roller 6 and an auxiliary roller 32 by rotation of a sheet feeding roller 28 through the conveying roller 6 by the LF motor 7 which is in the form of a pulse motor. Then, the recording medium 10 is fed in the main scan direction A by the conveying belt 29. The recording medium passes under the recording head 26 and is discharged out of the ink jet recording apparatus 102 by the discharging roller 30 rotating by the LF motor 7 through the conveying roller 6, the conveying belt 29 and the auxiliary roller 32. The minimum feeding pitch in the main scan direction A of the recording medium 10 by the LF motor 7 is 1/1800 inch which is the maximum common divisor of 1/180 inch, 1/300 inch and 1/360 inch corresponding to the ejection outlet pitches of the ink jet recording head 26 usable with the apparatus.

Figure 15:
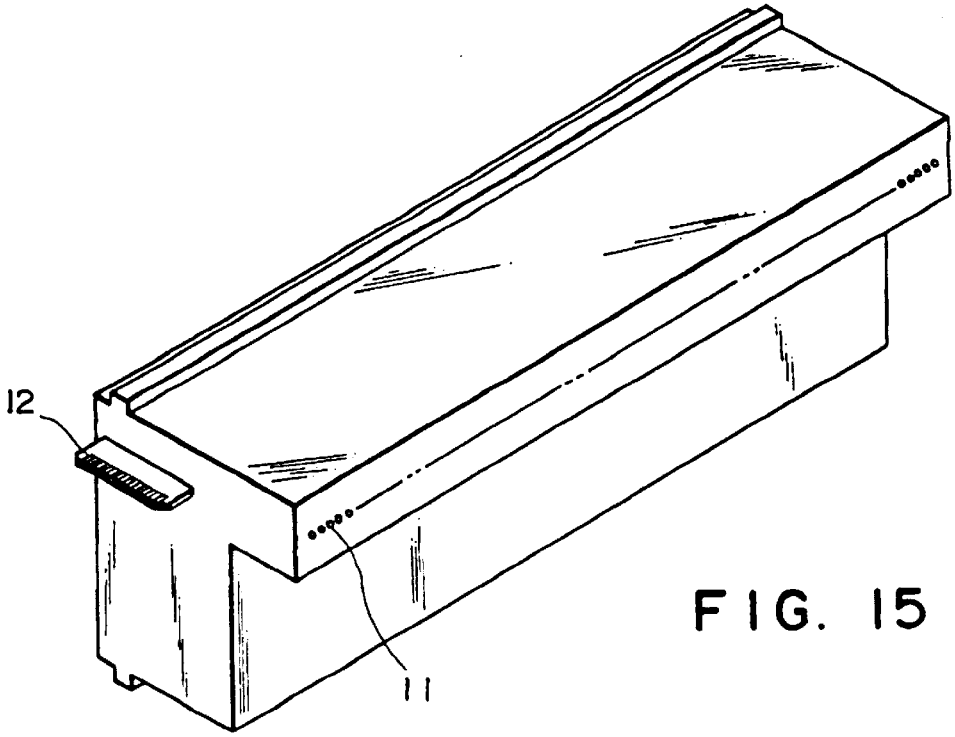
FIG. 15 is a perspective view of an example of an ink jet recording head usable with the ink jet recording apparatus of FIG. 14.

As shown in FIG. 15, the recording head 26 has plural ejection outlets 11 and is provided with a connector 12 having plural electrodes. The recording head 26 is provided, therein, with resistors 20*a*, 20*b* and 20*c* for ejection outlet pitches of 180 dpi, 300 dpi and 360 dpi, respectively, and with ejection outlet pitch selector switch 17 for selection among ejection outlet pitch resistors 20*a*, 20*b* and 20*c*. A common terminal 19 of the pitch resistors 20*a*, 20*b* and 20*c* and a common terminal 18 of the switch are connected to the electrodes of the connector 12 in a predetermined manner. The ink jet recording head 26, similarly to the recording head 1 in the foregoing embodiments, contains a ink container, and has electrothermal transducers.

Figure 16:
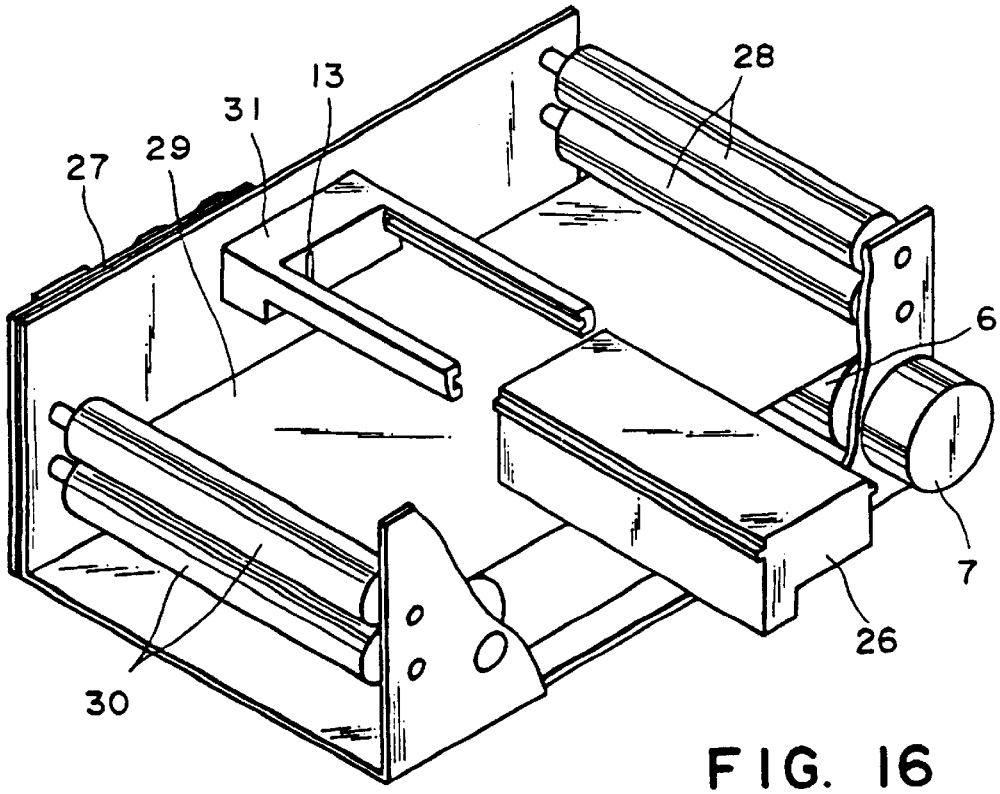
FIG. 16 is a perspective view of the ink jet recording apparatus of FIG. 14 without the ink jet recording head.

As shown in FIG. 16, the carriage 31 is provided with a connector 13 having plural electrodes and connectable with the connector 12 of the ink jet recording head 26, when the recording head 26 is mounted on the carriage. The connector 13 is connected with a control circuit 27.

Figure 17:
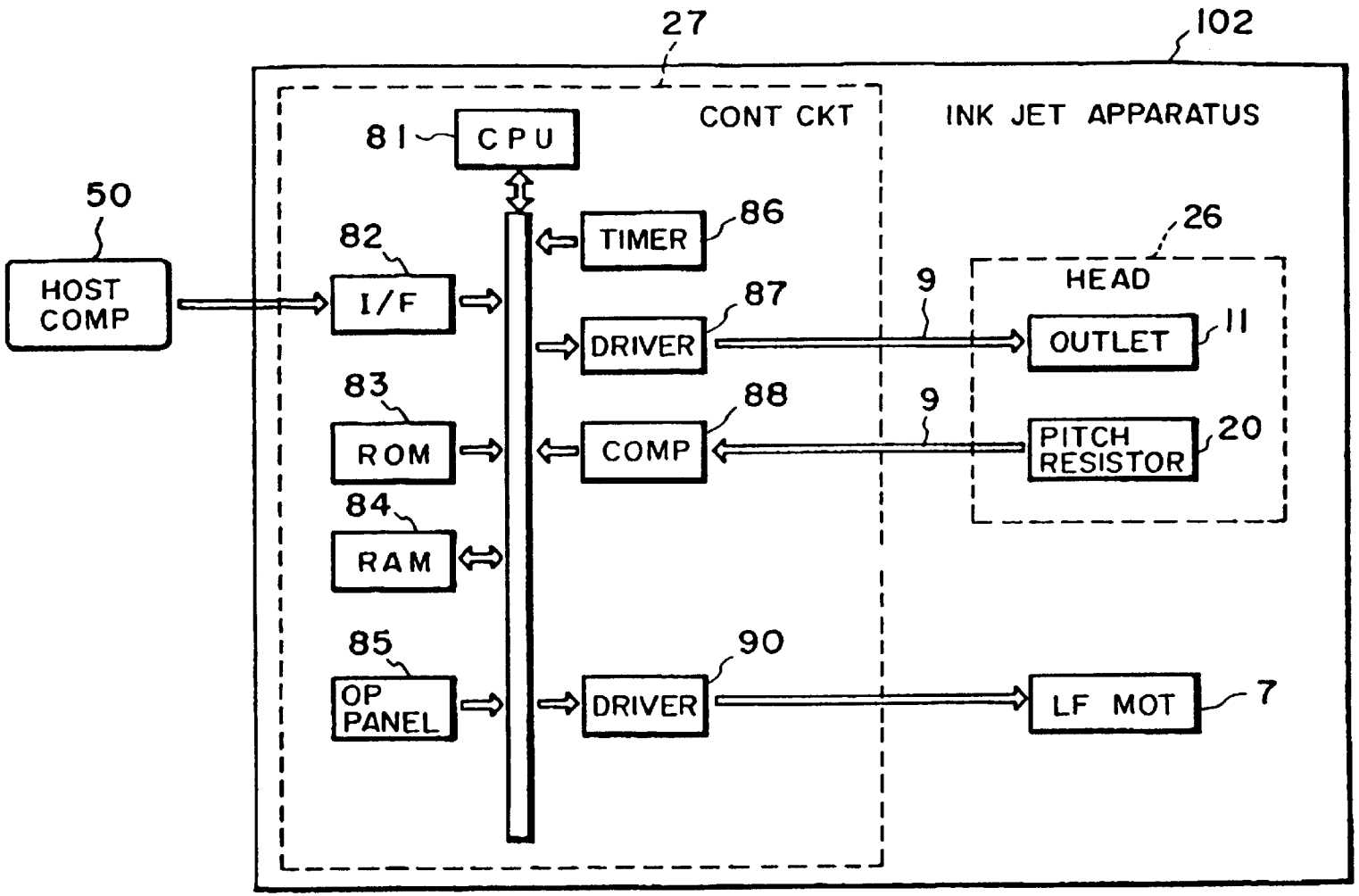
FIG. 17 is a block diagram of an example of a control circuit of the ink jet recording apparatus of FIG. 14.

As shown in FIG. 17, the control circuit 27 has the structure similar to that of the control circuit 8, but the comparator 89 is omitted. In this embodiment, the ejection timing of the recording head 26 is determined on the basis of the ejection outlet pitch of the recording head 26 mounted on the apparatus and the minimum feed pitch of the recording medium 10 by the LF motor 7 in the main scan direction A. The ejection timing profiles of the ink jet recording heads 26 having the different ejection outlet pitches relative to the driving pulse of the LF motor 7 is the same as shown in FIG. 7.

For example, the ejection timing using the recording head 26 having the recording density of 300 dpi is one for each 6 driving pulses of the LF motor, since the minimum feed pitch of the LF motor 7 is 1/1800 inch.

Figure 18:
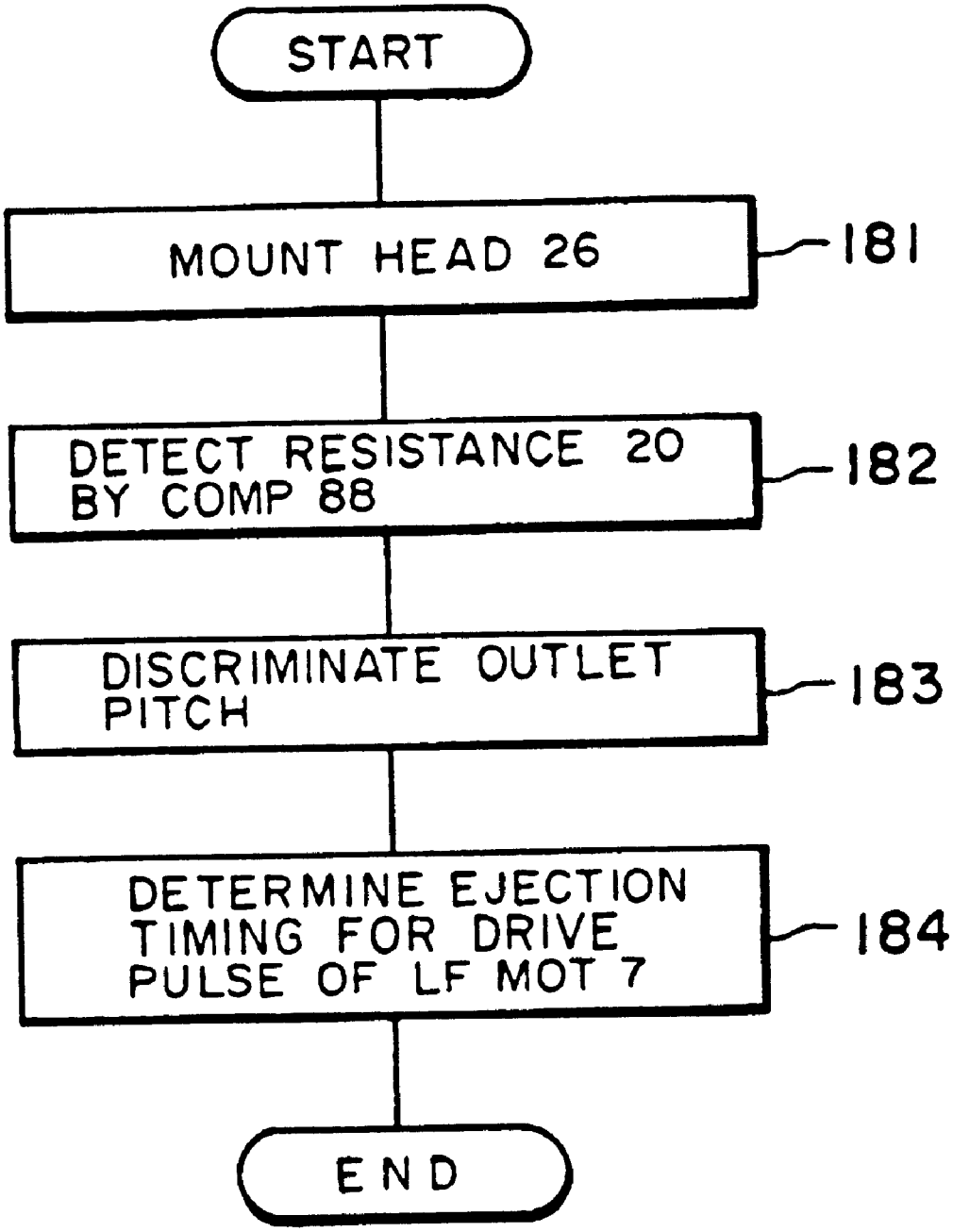
FIG. 18 is a flow chart showing a sequence of operation of the control circuit shown in FIG. 17.
Figure 19:
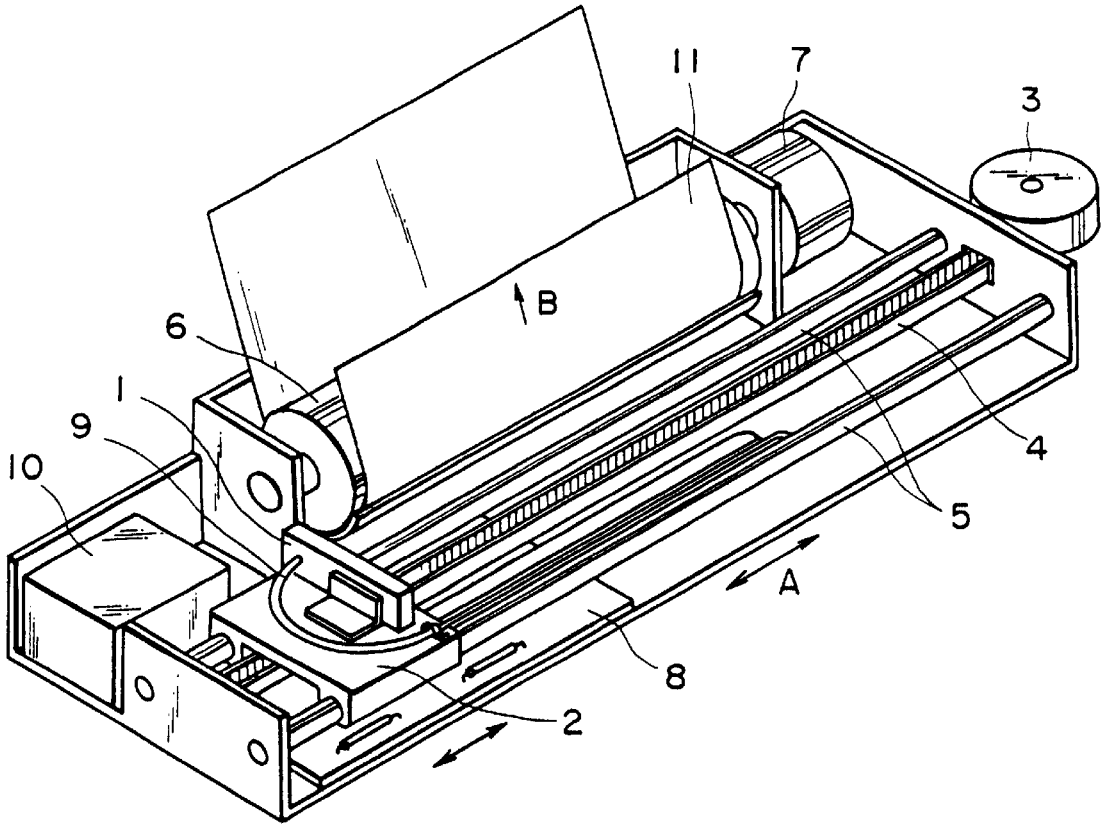
FIG. 19 PRIOR ART
FIG. 19 is a perspective view of a conventional apparatus.

Referring to FIG. 18 (flow chart), the description will be made as to the ejection timing setting operation for the ink jet recording head 26 by the control circuit 27.

When the ink jet recording head 26 in which the ejection outlet pitch resistor 20 is set is mounted on the carriage 31 (step 181), the comparator 88 detects the resistance of the ejection outlet pitch resistor 20 (step 182) to discriminate the ejection outlet pitch of the mounted recording head 26 (step 183). When the ejection outlet pitch is discriminated, the ejection timing of the recording head 26 is determined relative to the driving pulse of the LF. motor 7 on the basis of the ejection outlet pitch thus determined and the minimum feed pitch of the recording medium 10 by the LF motor 7 (step 184).

In this manner, when the ejection timing of the recording head 26 is determined, the LF motor 7 is driven through the driver 90, so that the main scan of the recording medium is started. The image data stored in the RAM 84 is read out, and the data are supplied to the ejection outlets 11 of the recording head as ejection signals through the driver 87 at the ejection timing thus determined.

In this embodiment, as described in the foregoing, the ejection outlet pitch is set as the ejection outlet information. However, since the range in which the ejection outlets 11 are disposed are determined in the case of the line type ink jet recording head, the ejection timing can be similarly determined when the ejection outlet information is indicative of the number of ejection outlets.

In this manner, even in the line type ink jet recording head is used in the ink jet recording apparatus, different ink jet recording heads having different ejection outlet pitches and/or different numbers of ejection outlets are usable with a predetermined range, the operator can use the recording apparatus for a variety of purposes, without the necessity of having a number of recording apparatuses.

In the embodiment described in conjunction with FIG. 14, there is provided means for feeding the recording medium and a carriage for mounting the recording head is fixed relative to the recording medium. However, the present invention is not limited to this. For example, if the ink jet recording head is movable relative to the recording medium, this embodiment can be usable as it is. In this case, in place of determining the ejection timing of the recording head relative to the feeding of the recording medium on the basis of the detected ejection outlet information, the ejection timing of the recording head may be determined relative to the relative movement between the recording medium and the recording head on the basis of the ejection outlet information detected.

In the foregoing, the description has been made with respect to the embodiments wherein the ink jet recording head has electrothernal transducers producing thermal energy contributable to ink ejection. However, the present invention is not limited to this type head, but is usable with an ink jet recording head which ejects the ink by actuation of piezoelectric elements.

As described in the foregoing, according to the present invention, the following advantageous effects are provided:

(1) Since the ink jet recording head is provided with ejection outlet information setting portion, the arrangement of the ejection outlets of the ink jet recording head can be known by detecting the ejection outlet information set therein.

(2) Since the ink jet recording head is detachably mountable to the carriage of the ink jet recording apparatus, and since the ejection timing and the feed amount of the recording medium during the recording operation are determined on the basis of the ejection outlet information set in the ink jet recording head, different ink jet recording heads having different arrangements of ejection outlets are usable with a single recording apparatus, so that the ink jet recording apparatus is given a high cost performance meeting various uses by the operator.

(3) Since the unit (increment) movement amount of the carriage for mounting the ink jet recording head or the unit feed amount of the recording medium is selected in relation to the arrangement of the ejection outlets of the ink jet recording head mounted thereon, the setting operation for the ejection timing or the feed amount of the recording material are easily set to provide efficient recording operation.

The typical structure and the operational principle are preferably those disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating elements and means for preliminary ejection not for the recording operation, which can stabilize the recording operation.

As regards the kinds of the recording head mountable, it may be a single head corresponding to a single color ink, or may be plural heads corresponding to the plurality of ink materials having different recording colors or densities. The present invention is effectively applicable to an apparatus having at least one of a monochromatic mode-mainly with black and a multi-color mode with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application and is intended to cover such modifications or changes as may come within the purposes of the improvements or the scope of the following claims.

What is claimed is:

1. An ink jet recording apparatus comprising:

an ink jet recording head having a plurality of ink ejection outlets to effect recording on a recording material;

a carriage for mounting said ink jet recording head, said carriage being reciprocable relative to the recording material;

wherein said ink jet recording head is one of a plurality of ink jet recording heads detachably mountable to said carriage and has an information set portion for providing information about a number of ejection outlets of said ink jet recording head and an interval of the ejection outlets, and energy generating elements for generating energy contributable to eject the ink through said ejection outlets;

feeding means for feeding the recording material; and a control circuit for controlling said feeding means and said recording head to control an amount of feeding of the recording material by said feeding means and timing of ink ejection by said recording head, relative to the distance of movement of said carriage, based on the number of the ejection outlets and the interval of the ejection outlets of the ink jet recording head mounted on said carriage, wherein a unit amount of feeding of the recording material is a common divisor of products of the numbers of the ejection outlets and the intervals of the ejection outlets of said respective ink jet recording heads mountable to said carriage, or a product of the common divisor and a reciprocal of any integer.

2. An ink jet recording apparatus as in claim 1, wherein said ink jet recording head is one of a plurality of ink jet recording heads selectively usable in said carriage and a unit movement amount of said carriage is an integer reciprocal of the pitch of the ejection outlets of each of the ink jet recording heads usable with said apparatus.

3. An apparatus according to claim 1, further comprising a slit plate having plural slits arranged at regular slit intervals in a direction of carriage movement, and an optical encoder movable together with said carriage adjacent said slit plate to detect the slits to produce slit detection signals and to supply the slit detection signals to said control circuit.

4. An apparatus according to claim 3, wherein each slit interval is an integer multiple of the pitch of the ejection outlets of each of the different ink jet recording heads usable with said apparatus.

5. An ink jet recording apparatus as in claim 1, wherein said ink jet recording head is one of a plurality of ink jet recording heads selectively usable in said carriage and a unit feed pitch of the recording medium is an integer reciprocal of a product of the number of ejection outlets and the pitch of the ejection outlets of each of the ink jet recording heads usable with said apparatus.

6. An apparatus according to claim 5, further comprising a slit plate having plural slits arranged at regular slit intervals in a direction of carriage movement, and an optical encoder movable together with said carriage adjacent said slit plate to detect the slits to produce slit detection signals and to supply the slit detection signals to said control circuit.

7. An apparatus according to claim 6, wherein each slit interval is an integer multiple of the pitch of the ejection outlets of each of the different ink jet recording heads usable with said apparatus.

8. An ink jet recording apparatus as in claim 1, wherein said ink jet recording head is one of a plurality of ink jet recording heads selectively usable in said carriage and a unit feed pitch of the recording medium is an integer reciprocal of the pitch of the ejection outlets of each of the ink jet recording heads usable with said apparatus.

9. An ink jet recording apparatus as in claim 1, wherein said ink jet recording head is one of a plurality of ink jet recording heads selectively usable in said carriage and a unit movement amount of said recording head is an integer reciprocal of the pitch of the ejection outlets.

10. An ink jet recording apparatus as in claim 1, wherein said ink jet recording head is one of a plurality of ink jet recording heads selectively usable in said carriage and a unit feed pitch of the recording medium relative to said ink jet recording head is an integer reciprocal of a product of the number of ejection outlets and the pitch of the ejection outlets.

11. An ink jet recording apparatus as in claim 1, wherein said ink jet recording head is one of a plurality of ink jet recording heads selectively usable in said carriage and a unit feed pitch of the recording medium is an integer reciprocal of a product of the number of ejection outlets and the pitch of the ejection outlets.

12. An ink jet recording apparatus as in claim 1, wherein said ink jet recording head is one of a plurality of ink jet recording heads selectively usable in said carriage and a unit feed pitch of the recording medium relative to said ink jet recording head is an integer reciprocal of a product of the number of ejection outlets and the pitch of the ejection outlets.

13. An ink jet recording apparatus as in claim 1, wherein said ink jet recording head is one of a plurality of ink jet recording heads selectively usable in said carriage and a unit movement amount of said carriage is an integer reciprocal of the pitch of the ejection outlets of each of the ink jet recording heads usable with said apparatus.

14. An ink jet recording apparatus as in claim 1, wherein said ink jet recording head is one of a plurality of ink jet recording heads selectively usable in said carriage and a unit feed pitch of the recording medium is an integer reciprocal of a product of the number of ejection outlets and the pitch of the ejection outlets of each of the ink jet recording heads usable with said apparatus.

15. An ink jet recording apparatus as in claim 1, wherein said ink jet recording head is one of a plurality of ink jet recording heads selectively usable in said carriage and a unit feed pitch of the recording medium is an integer reciprocal of the pitch of the ejection outlets of each of the ink jet recording heads usable with said apparatus.

16. An ink jet recording apparatus as in claim 1, wherein said ink jet recording head is one of a plurality of ink jet recording heads selectively usable in said carriage and a unit movement amount of said recording head is an integer reciprocal of the pitch of the ejection outlets.

17. An ink jet recording apparatus as in claim 1, wherein said ink jet recording head is one of a plurality of ink jet recording heads selectively usable in said carriage and a unit feed pitch of the recording medium is an integer reciprocal of a product of the number of ejection outlets and the pitch of the ejection outlets.

18. An ink jet recording apparatus comprising:

an ink jet recording head having a plurality of ink ejection outlets to effect recording on a recording material;

a carriage for mounting said ink jet recording head, said carriage being disposed at a fixed position relative to the recording material;

wherein said ink jet recording head is one of a plurality of ink jet recording heads detachably mountable to said carriage and has an information set portion for providing information about an interval of the ejection outlets, and energy generating elements for generating energy contributable to eject the ink through said ejection outlets;

feeding means for feeding the recording material; and a control circuit for controlling said recording head to control timing of ink ejection by said recording head, relative to a distance of movement of said feeding means, based on the interval of the ejection outlets of the ink jet recording head mounted on said carriage, wherein a unit amount of feeding of the recording material is a common divisor of the intervals of the ejection outlets of said respective ink jet recording heads mountable to said carriage, or a product of the common divisor and a reciprocal of any integer.

* * * * *

UNITED STATES PATENT AND TRADEMARK OFFICE

CERTIFICATE OF CORRECTION

PATENT NO. : 6,315,380 B1
DATED : March 24, 1997
INVENTOR(S) : Yokoi, Katsuyuki

It is certified that error appears in the above-identified patent and that said Letters Patent is hereby corrected as shown below:

Title page,
Item [56] References Cited, under FOREIGN PATENT DOCUMENTS:
"62-16663" should read -- 63-16663 --.

Column 3,
Line 6, "let" should read -- jet --; and
Line 32, "apparatuses" should read -- apparatus is --.

Column 5,
Line 32, "heady" should read -- head --.

Column 6,
Line 27, "head, 1," should read -- head 1, --; and
Line 49, "minimal" should read -- minimum --.

Column 7,
Line 23, "dipi" should read -- dpi --.

Column 9,
Line 3, "1/160" should read -- 1/60 --; and
Line 22, "jet:" should read -- jet --.

Column 10,
Line 36, "a," should read -- an --.

Column 11,
Line 2, "L.F." should read -- LF --.

UNITED STATES PATENT AND TRADEMARK OFFICE

CERTIFICATE OF CORRECTION

PATENT NO. : 6,315,380 B1
DATED : March 24, 1997
INVENTOR(S) : Yokoi, Katsuyuki

It is certified that error appears in the above-identified patent and that said Letters Patent is hereby corrected as shown below:

Column 12,
Line 7, "provide" should read -- provided --.

Column 13,
Line 10, "mode-mainly" should read -- mode mainly --.

Signed and Sealed this

Second Day of April, 2002

*Attest:*

*Attesting Officer*

JAMES E. ROGAN
*Director of the United States Patent and Trademark Office*